United States Patent [19]

Althaus et al.

[11] Patent Number: 5,029,391

[45] Date of Patent: Jul. 9, 1991

[54] PIVOT-HEAD RAZOR

[75] Inventors: Wolfgang Althaus, Wuppertal, Fed. Rep. of Germany; Dave Coffin, Norfolk, England

[73] Assignee: Wilkinson Sword Gesellschaft mit beschränkter Haftung, Solingen, Fed. Rep. of Germany

[21] Appl. No.: 494,158

[22] Filed: Mar. 14, 1990

[30] Foreign Application Priority Data

Mar. 15, 1989 [DE] Fed. Rep. of Germany ..... 8903182

[51] Int. Cl.[5] ..... B26B 21/14; B26B 21/30

[52] U.S. Cl. ..... 30/87; 30/85

[58] Field of Search ..... 30/42, 53, 85, 87, 88, 30/89

[56] References Cited

U.S. PATENT DOCUMENTS

| | | | |
|---|---|---|---|
| 1,455,725 | 5/1923 | Hartman . | |
| 3,795,979 | 3/1974 | Perry | 30/85 |
| 3,935,639 | 2/1976 | Terry et al. . | |
| 4,253,235 | 3/1981 | Jacobson | 30/87 |
| 4,403,414 | 9/1983 | Kiraly et al. | 30/87 |
| 4,475,286 | 10/1984 | Saito | 30/85 |
| 4,498,235 | 2/1985 | Jacobson | 30/87 |
| 4,587,729 | 5/1986 | Jacobson | 30/87 |
| 4,638,560 | 1/1987 | Higashi | 30/87 |
| 4,797,998 | 1/1989 | Motta . | |

FOREIGN PATENT DOCUMENTS

| | | |
|---|---|---|
| 0195602 | 9/1986 | European Pat. Off. . |
| 0271185 | 6/1988 | European Pat. Off. . |
| 3635552 | 4/1988 | Fed. Rep. of Germany . |
| 2116470 | 9/1983 | United Kingdom . |

*Primary Examiner*—Douglas D. Watts
*Assistant Examiner*—Paul M. Heyrana, Sr.
*Attorney, Agent, or Firm*—Robert W. Becker & Associates

[57] ABSTRACT

A twin-pivot-head razor with a head that has an outer body that is provided with a window to receive a separate subassembly in which is integrated the holding mechanism for the razor blade unit. Starting from a spring-loaded neutral position, the razor blade unit, via this holding mechanism, can carry out pivoting movements about an axis that is parallel to the cutting edge of the razor blade. The separate subassembly is also pivotable within the outer body about an axis that is perpendicular to the aforementioned pivot axis, whereby the neutral position is formed by a spring arrangement within the outer body.

8 Claims, 3 Drawing Sheets

PIVOT-HEAD RAZOR

BACKGROUND OF THE INVENTION

The present invention relates to a twin pivot-head razor having a handle at the front end of which is disposed a head in which is disposed a holding means that defines a horizontal pivot axis that is parallel to the cutting edge or edges of razor blade means of a razor blade unit that is adapted to be held by the holding means and to be pivotable out of a spring-loaded neutral position, with the razor blade unit additionally being mounted in the head in such a way as to be pivotable, again starting from a spring-loaded neutral position, about a second axis that is disposed in a longitudinal plane of symmetry of the razor and extends at right angles to the aforementioned pivot axis.

A twin pivot-head razor of this general type is known from published European patent application 0 195 602. Disposed at the front end of a handle of this known razor is a head that contains the combination holding and pivoting mechanism for a razor blade unit. For this purpose, a Y-shaped plate-type spring is disposed within the handle as well as within the head of the razor. In this connection, two parallel limbs extend within the handle; these limbs are connected together at the bottom as a single piece and are fixed in position within the handle by the connecting piece in such a way that the limbs can bend freely. In the region of the head of the razor, the front ends of the limbs are bent outwardly and in addition are bent relative to their longitudinal extension within the handle. The front ends of the limbs form arms that are angled off inwardly coaxially to one another in such a way that they form a holding means for a razor blade unit and also define a horizontal pivot axis that extends parallel to the cutting edge or edges of the razor blade or blades. The razor blade unit can be pivoted out of a spring-loaded neutral position about this pivot axis, whereby a cam on the back of the razor blade unit rests against the head of the razor to define this neutral position. By embodying the arms or limbs as plate-type springs, and furthermore by angling or bending these limbs in the vicinity of the transition between the handle and the head of the razor, the razor blade unit can in addition be pivoted about an axis that extends at right angles to the plane defined by the limbs in the region of the head of the razor.

Although this known twin pivot-head razor allows a two-dimensional pivoting movement of the razor blade unit via two pivot axes, so that the razor blade unit can optimally conform to the contour of the face of a user during a shaving process, the construction of this known razor is very complicated and requires manual skill during assembly in order to be able to install the relatively long, Y-shaped spring not only in the handle but also in the head of the razor, whereby in addition the front ends of the limbs must be inserted through openings in the head of the razor. Furthermore, the limbs must be bent very exactly so that they fit precisely in the housing. Deviations from the prescribed angles adversely affect the ability of the razor blade to pivot.

It is therefore an object of the present invention to provide a structurally simplified twin pivot-head razor that above all is easy to assemble.

Brief Description of the Drawings

This object and other objects and advantages of the present invention, will appear more clearly from the following specification in conjunction with the accompanying schematic drawings, in which.

SUMMARY OF THE INVENTION

Figure 1:
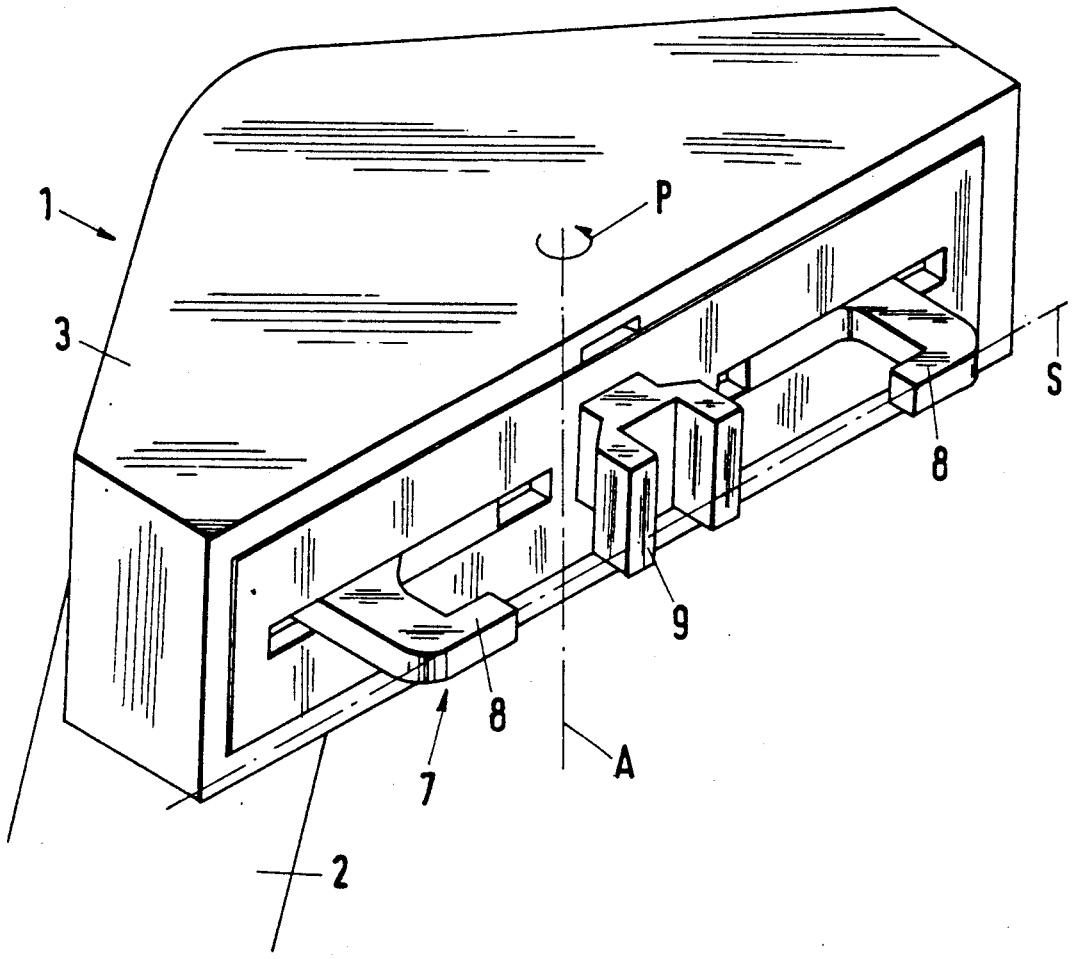
FIG. 1 is a partial perspective view of one exemplary embodiment of the inventive razor, with a holding mechanism, in the form of a separate subassembly for the razor blade unit, being inserted into the head of the razor.

The pivot-head razor of the present invention is characterized primarily in that the head of the razor has an outer body that is provided with a window at a front end thereof to receive and hold in position a separate subassembly that contains the holding means for the razor blade unit, with the subassembly being mounted within the outer body in such a way as to be pivotable about the second axis.

The present invention provides a technically very straightforward twin pivot-head razor that can be assembled in an extremely simple manner. The actual housing of the razor, i.e. the handle with the outer body for the head of the razor, can be produced in a single injection molding process. The separate subassembly with the holding means for the razor blade unit can also be prefabricated. It is then merely necessary to only insert the prefabricated separate subassembly into the outer body of the razor head, with this process not requiring any special effort. The separate subassembly is responsible for the transverse movements of the razor blade unit, whereas the holding means integrated in the separate subassembly serves for the conventional pivoting movements about the horizontal pivot axis. Such a separate subassembly thus represents a technically straightforward possibility for on the one hand being able to dispose the holding means for the razor blade unit within the head of the razor, and on the other hand for enabling a transverse movement of the razor blade unit in a technically straightforward manner.

Pursuant to one specific embodiment of the present invention, the second or perpendicular axis is preferably disposed in the vicinity of the window of the outer body of the razor head. This results in an optimum pivoting condition for the separate subassembly and hence for the razor blade unit.

In order to provide a technically straightforward pivotable mounting of the separate subassembly within the body of the razor head, it is proposed pursuant to a further embodiment of the present invention that the top and bottom of the subassembly be provided with pins, with corresponding recesses, each of which has an undercut, being provided in the outer body of the razor head, with the pins of the subassembly catching in these recesses. In this way, it is also possible to have a technically straightforward assembly of the separate subassembly within the body of the razor head.

For the spring-loaded neutral position of the separate subassembly, it is proposed that at least one spring means be disposed between the rear wall of the outer body and the back of the separate subassembly. Pursuant to a first alternative, a respective compression spring is disposed on both sides of the central longitudinal plane of symmetry between the rear wall of the outer body and the back of the separate subassembly, with the compression spring preferably being embodied as a helical spring that is disposed on pins formed on the rear wall of the outer body and on the back of the separate subassembly. As a second alternative, a flat spring that is disposed in the longitudinal plane of symmetry and projects rearwardly is fixedly disposed on the back of the separate subassembly; the other free end of this flat spring is freely movably held in position in a slotted receiving means on the rear wall of the outer body. All of these spring arrangements represent a technically straightforward possibility for placing the separate subassembly in its neutral position, starting from which the subassembly can then carry out the pivoting movements.

In order to provide the user with the possibility of either allowing the razor blade unit to pivot or to be fixed in position, it is finally proposed pursuant to a further specific embodiment of the inventive pivot-head razor, that it be possible to lock the razor blade unit in its shaving position by means of a locking device that is actuated by the user.

Further specific features of the present invention will be described in detail subsequently.

Description of Preferred Embodiments

Referring now to the drawings in detail, the twin pivot-head wet razor has a head that is disposed at the front end of a handle 2. The head 1 of the razor is formed by a body 3 that has a window 4 at the front; the parts that belong to the actual holding means for the non-illustrated razor blade unit can be inserted into the window 4 in the form of a separate subassembly 5.

In both of the embodiments that are illustrated, the separate subassembly 5 comprises a housing 6 in which is primarily disposed a holding means 7 in the form of a pronged holding means having receiving prongs 8. By means of a nonillustrated actuating element, for example in the form of a slide or a push button, the free ends of the receiving prongs 8 of the holding means 7 can be pivoted outwardly in such a way that after the receiving prongs 8 have been pivoted back, they engage in appropriate recesses of the razor blade unit to receive and hold the same. In so doing, the connecting line between the free, inwardly directed ends of the receiving prongs 8 defines a pivot axis S about which the razor blade unit is pivotable so that while shaving, the razor blade can conform to the contour of the face while maintaining a favorable shaving angle as a consequence of the pivoting movements.

In order during this process to be able to hold the razor blade unit in a spring-loaded neutral position, a spring-loaded or resilient cam 9 that can be pressed in is furthermore disposed in the housing 6 of the separate subassembly 5. The cam 9 is supported against the back of the razor blade unit which for this purpose is provided with a rib that is disposed in the longitudinal plane of symmetry.

In addition to being able to carry out a pivoting movement about the pivot axis S, the razor blade unit can also be pivoted about a vertical axis A that is disposed in the longitudinal plane of symmetry of the head 1 of the razor. For this purpose, the separate subassembly 5 is pivotably mounted about the axis A within the body 3 of the razor head 1. To accomplish this pivoting movement, pins 10 are formed onto the top and bottom of the housing 6, with these pins 10 being disposed in the axis A and defining the same. Recesses 12 having undercuts 11 are provided in the interior of the body 3; these recesses 12 correspond with the pins 10 of the housing 6 of the subassembly 5. When the subassembly 5, with its housing 6, is placed in the body 3 of the razor head 1, the pins 10, after passing into the undercuts 11, catch in the recesses 12, in which connection the diameter relationships are such that the subassembly 5 can carry out a pivoting movement within the body 3. For this purpose, the side walls 13 of the housing 6 are also rounded off.

Figure 2:
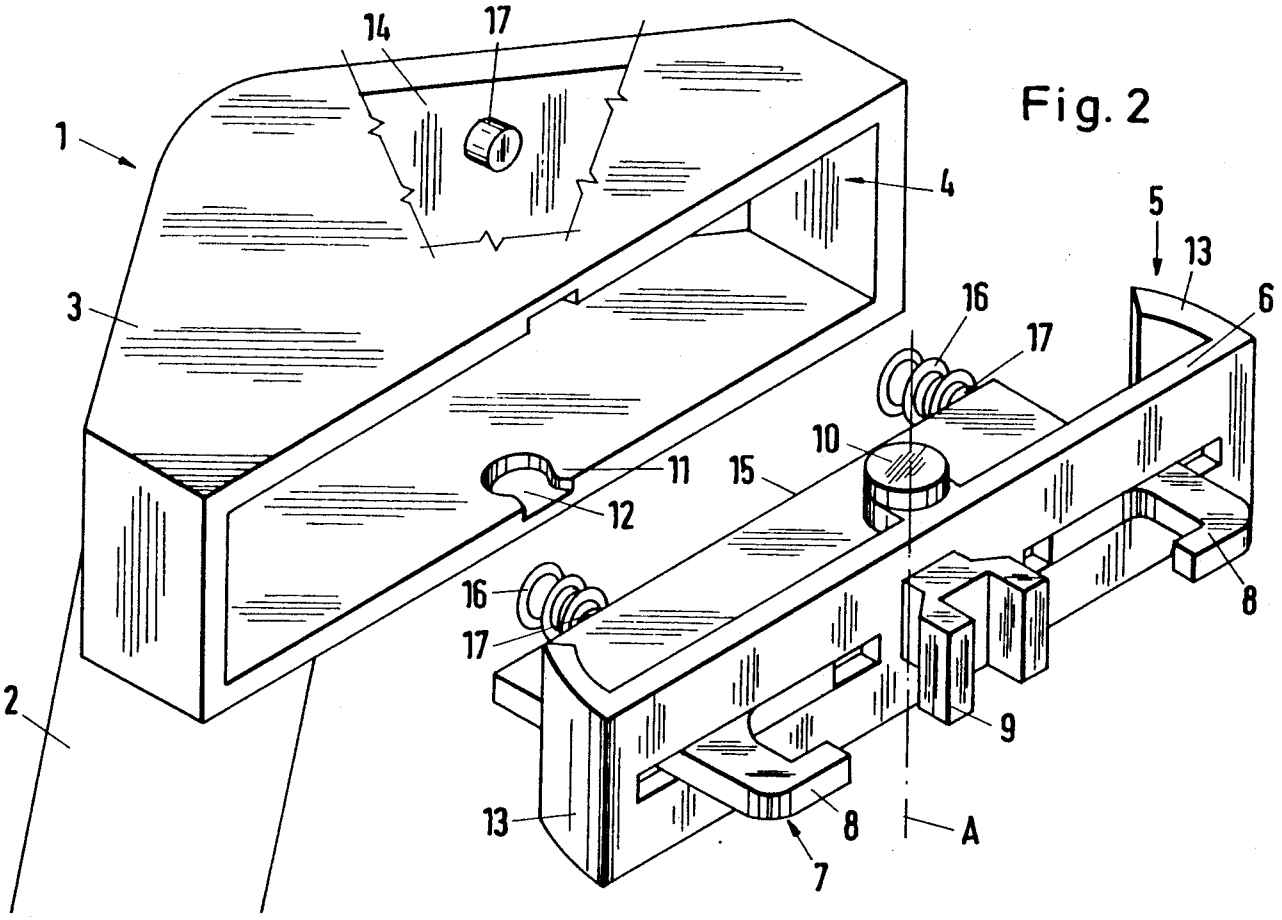
FIG. 2 shows a first embodiment of the separate subassembly prior to insertion into the head of the razor.

So that the separate subassembly 5, starting from a spring-loaded neutral position, can pivot, a spring arrangement is provided between the rear wall 14 of the body 3 of the razor head 1, and the back 15 of the subassembly 5. In the embodiment illustrated in FIG. 2, two helical compression springs 16 are provided for this purpose; these springs 16 are equally spaced from the longitudinal plane of symmetry of the head 1 of the razor. In order to fix the position of these compression springs 16, pairs of pins 17 are disposed both on the back 15 of the subassembly 5 as well as on the rear wall 14 of the body 3; the helical compression springs 16 are placed upon these pins 17.

Figure 3:
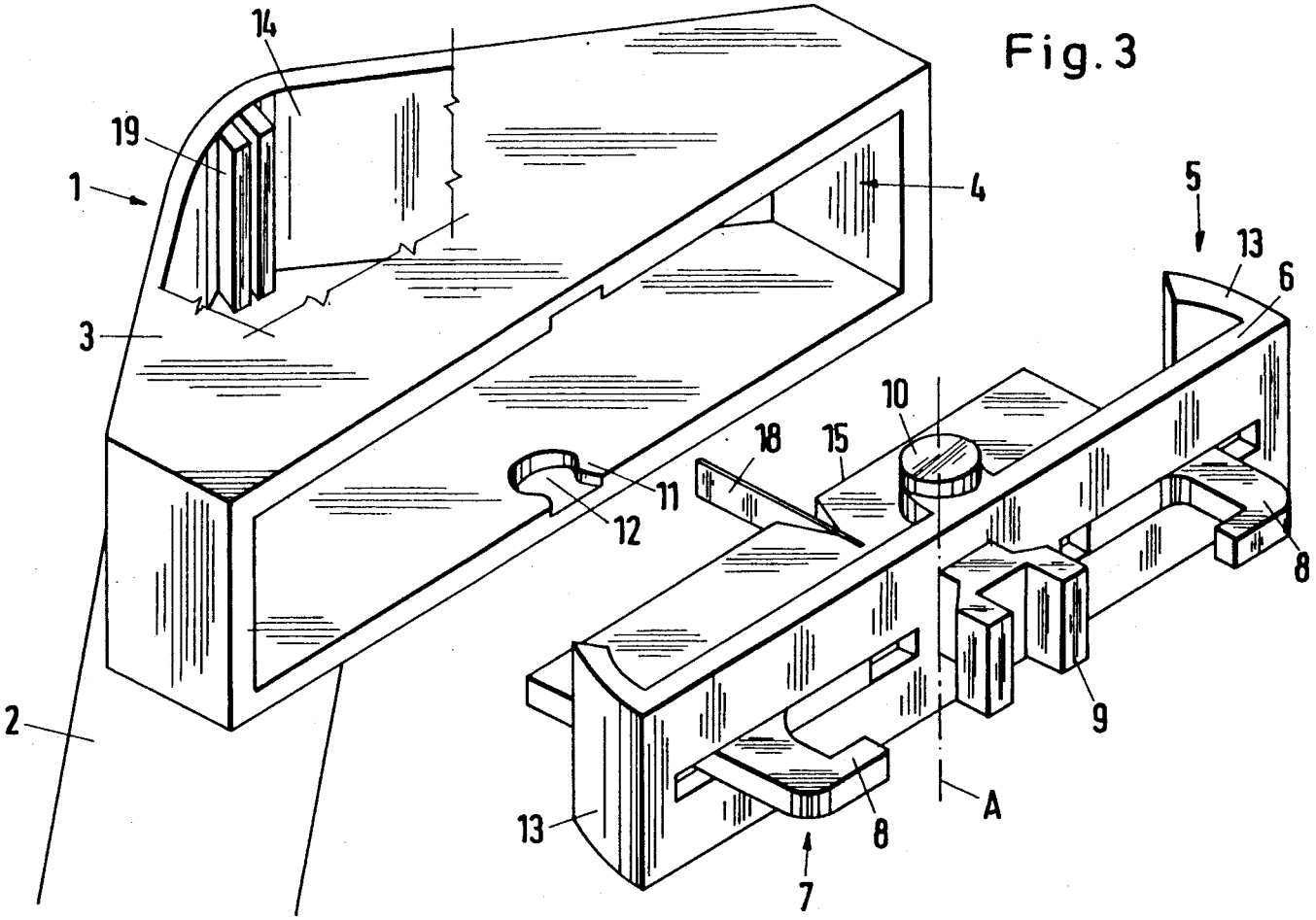
FIG. 3 shows a second embodiment of the separate subassembly prior to insertion into the head of the razor.

In the embodiment illustrated in FIG. 3, a single flat spring 18 is provided as the spring means. This spring 18 projects out at right angles and is disposed in the longitudinal plane of symmetry of the razor head 1, with the front end of the spring 18 being secured in the housing 6 of the subassembly 5. The rear, free end of the flat spring 18 extends into a slotted receiving means 19 that is formed on the rear wall 14 of the body 3 and in which the spring 18 can be longitudinally shifted.

In both of the illustrated embodiments, the separate subassembly 5, and hence the razor blade unit, are pivotable about the axis A, as indicated by the arrow P in FIG. 1. When the subassembly 5 undergoes a pivoting movement during the shaving process, the spring means is tensioned in such a way that when the subassembly 5 is released, it returns to its neutral position and assumes the starting position. In this way, the razor blade unit can carry out a pivoting movement about two axes, so that during shaving the razor blade unit can optimally conform to the contour of the face.

If the user wants to be able to determine whether the razor blade unit pivots or is fixed, the head 1 of the razor can additionally be equipped with a non-illustrated blocking mechanism via which the razor blade unit can be appropriately locked in position.

The present invention is, of course, in no way restricted to the specific disclosure of the specification and drawings, but also encompasses any modifications within the scope of the appended claims.

What we claim is:

1. In a twin pivot-head razor having a handle at the front end of which is disposed a head in which is disposed a holding means that defines a first pivot axis that is parallel to the cutting edge or edges of razor blade means of a razor blade unit that is held by said holding means and is pivotable out of a spring-loaded neutral position, with said razor blade unit additionally being mounted in said head in such a way as to be pivotable, again starting from a spring-loaded neutral position, about a second axis that is disposed in a longitudinal plane of symmetry of said razor and extends at right angles to said first pivot axis the improvement wherein:

said razor head has an outer body that is provided with a window at a front end thereof to receive therethrough and hold in position therein a separate subassembly that contains said holding means for said razor blade unit, with said subassembly being mounted within said outer body in such a way as to be pivotable about said second axis.

2. A pivot-head razor according to claim 1, in which said second axis is disposed in the vicinity of said window of said outer body.

3. A pivot-head razor according to claim 1, in which, to effect said pivotable mounting of said subassembly within said outer body, said subassembly is provided on upper and lower sides thereof with pins, and said outer body is provided with corresponding recesses, each with an undercut, for receiving said pins in a catching manner.

4. A pivot-head razor according to claim 1, in which, to effect said spring-loaded neutral position, at least one spring is disposed between a rear wall of said outer body and a back of said subassembly remote from said holding means thereof.

5. A pivot-head razor according to claim 4, which includes two compression springs, one on each side of said central longitudinal plane of symmetry.

6. A pivot-head razor according to claim 5, in which said springs are helical springs disposed on pin means formed on said rear wall of said outer body and on said back of said subassembly.

7. A pivot-head razor according to claim 4, which includes a flat spring that is disposed in said longitudinal plane of symmetry, is fixedly disposed in said back of said subassembly, and projects with a free end from said subassembly rearwardly toward said rear wall of said outer body, where it is freely movably held in position in a slotted receiving means on said rear wall.

8. A pivot-head razor according to claim 1, which includes a locking mechanism that is actuatable by a user for locking said razor blade unit in a shaving position.

* * * * *